US010161247B2

(12) United States Patent
Tvedt

(10) Patent No.: US 10,161,247 B2
(45) Date of Patent: Dec. 25, 2018

(54) ROV MOUNTABLE SUBSEA PUMP FLUSHING AND SAMPLING SYSTEM

(71) Applicant: OneSubsea IP UK Limited, London (GB)

(72) Inventor: Jostein Tvedt, Bergen (NO)

(73) Assignee: OneSubsea IP UK Limited (GB)

( * ) Notice: Subject to any disclaimer, the term of this patent is extended or adjusted under 35 U.S.C. 154(b) by 0 days.

(21) Appl. No.: 15/039,941

(22) PCT Filed: Nov. 26, 2014

(86) PCT No.: PCT/US2014/067644
§ 371 (c)(1),
(2) Date: May 27, 2016

(87) PCT Pub. No.: WO2015/081216
PCT Pub. Date: Jun. 4, 2015

(65) Prior Publication Data

US 2017/0002651 A1 Jan. 5, 2017

(30) Foreign Application Priority Data

Nov. 28, 2013 (GB) ..... 1320986.1

(51) Int. Cl.
*E21B 41/04* (2006.01)
*E21B 49/08* (2006.01)
(Continued)

(52) U.S. Cl.
CPC ..... *E21B 49/001* (2013.01); *E21B 34/00* (2013.01); *E21B 41/04* (2013.01); *E21B 43/01* (2013.01);
(Continued)

(58) Field of Classification Search
CPC ..... E21B 34/00; E21B 34/04; E21B 41/04; E21B 43/01; E21B 43/129; E21B 47/10; E21B 49/001; E21B 49/08
See application file for complete search history.

(56) References Cited

U.S. PATENT DOCUMENTS 5,398,762 A * 3/1995 Stinessen ..... E21B 43/01 166/356
6,435,279 B1 * 8/2002 Howe ..... E21B 49/086 166/336
(Continued)

FOREIGN PATENT DOCUMENTS

GB 2460170 B 12/2012
WO 2012/161585 A1 11/2012

OTHER PUBLICATIONS

International Application No. PCT/US2014/067644 Search Report and Written Opinion dated Feb. 20, 2015 (8 pages).
(Continued)

*Primary Examiner* — Matthew R Buck
(74) *Attorney, Agent, or Firm* — Conley Rose, P.C.

(57) ABSTRACT

An ROV-mountable flush and sample skid is described that reduces the project cost and deliveries, and also improves HSE risk during Subsea Pump installation campaigns. The ROV skid can be configured as part of a standard ROV tooling across different projects. The tool also reduces the total pump module installation weight that is important in deepwater applications. The ROV-mountable flushing and sampling skid is mounted to an ROV and deployed to a subsea location to provide flushing of and sampling of barrier oil from a barrier oil supply jumper from an subsea umbilical termination assembly. The Subsea pump flushing and sampling ROV skid includes of a set of flush accumulators with enough capacity to flush the installed jumpers
(Continued)

clean, and also one or more sample accumulators configured to sample the barrier oil after the flushing has been performed.

25 Claims, 7 Drawing Sheets

(51) Int. Cl.

| | |
|---|---|
| ***E21B 49/00*** | (2006.01) |
| ***E21B 34/00*** | (2006.01) |
| ***E21B 43/01*** | (2006.01) |
| ***E21B 43/12*** | (2006.01) |
| ***E21B 47/10*** | (2012.01) |

(52) U.S. Cl.
CPC ..... *E21B 43/129* (2013.01); *E21B 47/10* (2013.01); *E21B 49/08* (2013.01)

(56) References Cited

U.S. PATENT DOCUMENTS 8,281,862 B2 10/2012 Barber et al.
8,376,050 B2 * 2/2013 Cumming ..... E21B 37/06 166/250.01
8,381,578 B2 * 2/2013 Sweeney ..... B63C 11/42 405/154.1
8,430,168 B2 * 4/2013 Goodall ..... E21B 33/0385 166/336
8,523,540 B2 * 9/2013 Eide ..... F04D 29/586 310/52
2013/0025874 A1 1/2013 Saunders et al.
2013/0284443 A1 10/2013 Gordon et al.
2015/0204167 A1 * 7/2015 Skeels ..... E21B 33/038 166/344
2016/0076353 A1 * 3/2016 Berle ..... F04D 13/10 210/650
2016/0109063 A1 * 4/2016 Berry ..... E21B 43/128 184/105.1

OTHER PUBLICATIONS

United Kingdom Patent Application No. GB13209861 Combined Search and Examination Report dated Oct. 9, 2014 (6 pages).
http://www.interventiontechnology.com/en/cms/user files/File/PDFs/ROV_Intervention_Catalogue_pdf, ROV Intervention Tooling Catalogue (SUBSEA 7) (84 pages).

* cited by examiner

ROV MOUNTABLE SUBSEA PUMP FLUSHING AND SAMPLING SYSTEM

CROSS-REFERENCE TO RELATED APPLICATIONS

The present application is a 35 U.S.C. § 371 national stage entry of PCT/US2014/067644, filed Nov. 26, 2014, and entitled "ROV Mountable Subsea Pump Flushing And Sampling System," which claims priority to United Kingdom Patent Application No. 1320986.1, filed Nov. 28, 2013, and entitled "ROV Mountable Subsea Pump Flushing and Sampling System" both of which are hereby incorporated by reference in their entireties for all purposes.

FIELD

The present disclosure relates generally to subsea fluid processing. More particularly, the present disclosure relates to systems and methods for deploying subsea pumping equipment including flushing and fluid sampling.

BACKGROUND

After subsea installation and hook-up, an oil filled subsea pump needs a very clean barrier fluid oil for proper operation. After installation and jumper hook-up from a subsea umbilical termination assembly (SUTA) to the subsea pump is completed, a flush and sample of the system is required in order to remove seawater ingress and particles that may have occurred during subsea connection. Conventionally, a dedicated installation tool with flush and sample accumulators has been installed together with the subsea pump module. The dedicated installation tool is mounted on top of the subsea pump module resulting in a large working height for preparatory work tasks on the deploying vessel's deck. Additionally, a load transfer mechanism typically needs to be used between the pump module and the vessel hook rigging, also resulting in a high total installation weight. Furthermore, many projects involve deployment of several pump modules, each of which includes its own dedicated installation tool mounted thereon.

SUMMARY

According to some embodiments, a subsea deployable production fluid processing system is described that includes: a submersible electric motor configured to operate while filled with a barrier oil and to be deployed in a subsea location; a supply receptacle configured to accept a supply conduit carrying the barrier oil; a remotely operated underwater (ROV) mountable flushing unit configured to be deployed to the subsea location while mounted to an ROV, said flushing unit including one or more flushing accumulators; and a valve system configured to allow entry of the barrier oil from the supply conduit and to allow fluid communication with said ROV mountable flushing unit, said flushing accumulators being configured to accept fluid in said supply conduit so as to flush said supply conduit. According to some embodiments, the flushing unit also includes at least one sampling accumulator configured to draw a fluid sample of barrier oil from said supply conduit after being flushed by the flushing accumulators. The flushing unit can be configured to produce a sample of barrier oil at a surface location for testing after retrieval, or it can be configured to analyze the sample while remaining in the subsea location. According to some embodiments, the system can include a subsea umbilical interface unit configured to supply barrier oil from an umbilical conduit to said supply conduit. According to some embodiments, the electric motor is configured to drive one of the following types of equipment: multiphase pump; single phase pump; hybrid pump; and compressor. According to some embodiments, the fluid processing system includes one or more accumulators adapted to provide barrier oil supply pressure compensation.

According to some embodiments, an ROV mountable flushing unit is described that includes: a frame configured for attachment to an ROV so as to allow deployment by the ROV of the flushing unit to a subsea location where a subsea processing system is located, said subsea processing system including a barrier oil filled electric motor and configured to fluidly connect to barrier oil supply conduit; and one or more flushing accumulators mounted within said frame and configured to flush fluid from said barrier oil supply conduit following connection to said subsea processing system.

According to some embodiments, a method is described for installing a fluid processing system in a subsea location. The method includes: positioning the fluid processing system in the subsea location, said fluid processing system including an electric motor configured for operation while filled with a barrier oil; deploying a flushing unit mounted to an ROV to the subsea location, said flushing unit including one or more flushing accumulators; connecting a supply conduit to said fluid processing system while at the subsea location, the supply conduit configured to supply barrier oil to said fluid processing system; after said connecting, flushing fluid from said supply conduit into said one or more flushing accumulators of said flushing unit; after said flushing, retrieving the flushing unit to a sea surface location using the ROV; and after said flushing, supplying barrier oil from said supply conduit to said electric motor.

According to some embodiments, the method further includes, after said flushing and before said retrieving and said supplying, taking a sample of fluid from said supply conduit by drawing said sample into a sampling accumulator on said flushing unit; and analyzing said sample for contaminants in the barrier oil, wherein said supplying is only performed in cases where the sample shows the barrier oil is suitably free from contaminants.

These together with other aspects, features, and advantages of the present disclosure, along with the various features of novelty, which characterize the disclosure, are pointed out with particularity in the claims annexed to and forming a part of this disclosure. The above aspects and advantages are neither exhaustive nor individually or jointly critical to the spirit or practice of the disclosure. Other aspects, features, and advantages of the present disclosure will become readily apparent to those skilled in the art from the following description of exemplary embodiments in combination with the accompanying drawings. Accordingly, the drawings and description are to be regarded as illustrative in nature, and not restrictive.

BRIEF DESCRIPTION OF THE DRAWINGS

To assist those of ordinary skill in the relevant art in making and using the subject matter hereof, reference is made to the appended drawings, in which like reference numerals refer to similar elements.

DETAILED DESCRIPTION

In the following detailed description of the preferred embodiments, reference is made to accompanying drawings, which form a part hereof, and within which are shown by way of illustration specific embodiments by which the disclosure may be practiced. It is to be understood that other embodiments may be utilized and structural changes may be made without departing from the scope of the disclosure.

The particulars shown herein are by way of example and for purposes of illustrative discussion of the embodiments of the present disclosure only, and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure; the description taken with the drawings making apparent to those skilled in the art how the several forms of the present disclosure may be embodied in practice. Further, like reference numbers and designations in the various drawings indicate like elements.

Figure 1:
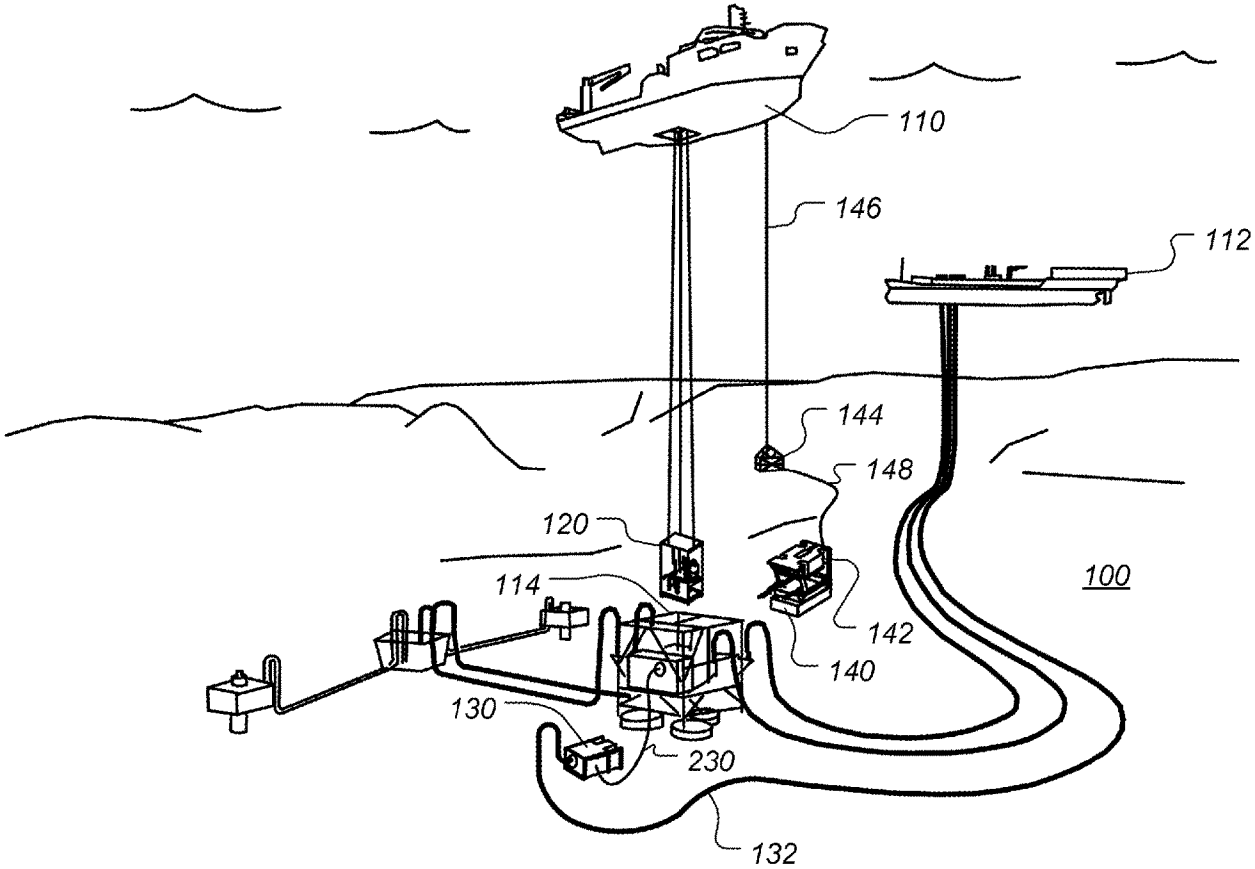
FIG. 1 is a diagram illustrating deployment of a pump module using an ROV mountable subsea pump flushing and sampling system, according to some embodiments.

FIG. 1 is a diagram illustrating deployment of a pump module using a remotely operated vehicle (ROV) mountable subsea pump flushing and sampling system, according to some embodiments. The subsea pump module 120 is being deployed from vessel 110 into subsea station 114 on seafloor 100. A subsea umbilical termination assembly (SUTA) 130 is shown on the seafloor near station 114. SUTA 130 is connected to umbilical 132 to floating production, storage and offloading unit (FPSO) 112 or other a surface facility such as a platform. SUTA 130 is also connected to station 114 via one or more jumpers (e.g., jumper 230). An ROV mountable subsea pump flushing and sampling system or skid 140 is carried on ROV 142. ROV 142 is tethered using main lift umbilical 146 to tether management system 144, which manages the free-swimming tether 148 to ROV 142. According to some embodiments, as described more fully herein, ROV mountable flush and sample skid 140 reduces the project cost and deliveries, and also improves HSE risk during Subsea Pump installation campaigns.

Figure 2:
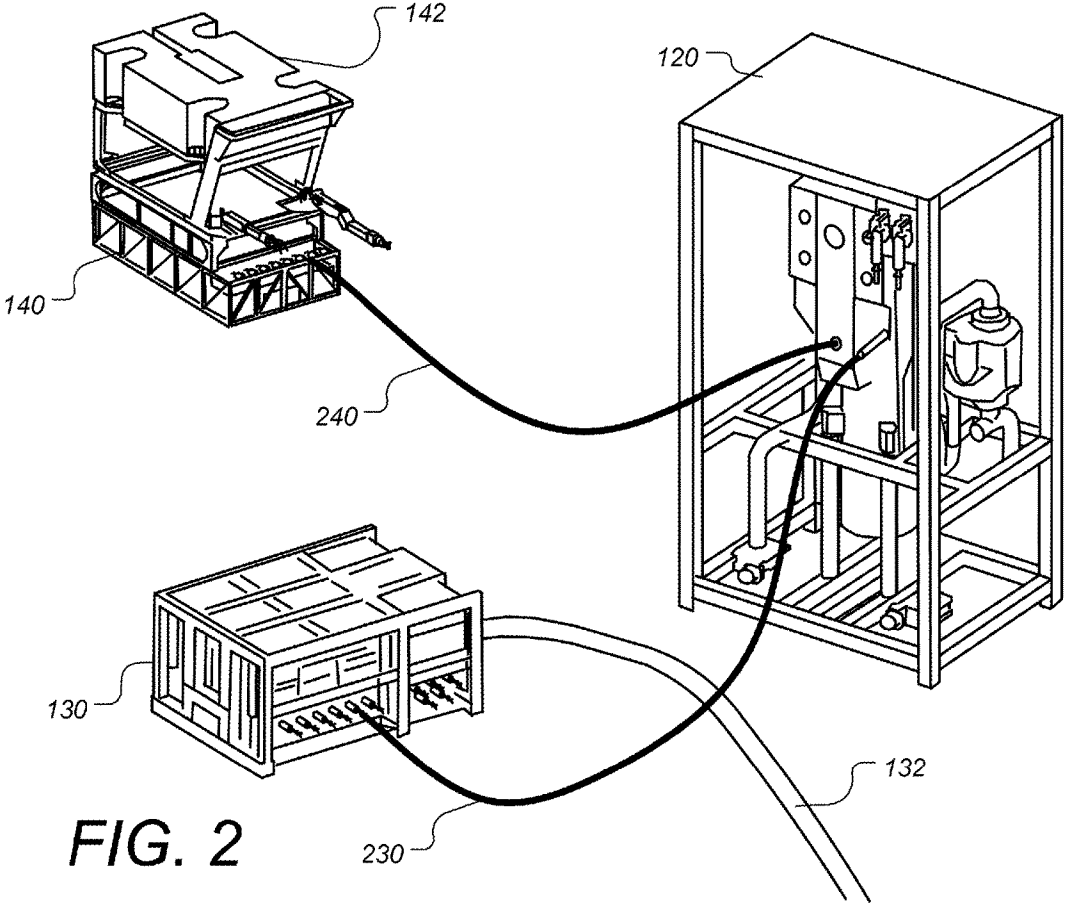
FIG. 2 is a diagram illustrating further detail of a pump module, SUTA, and ROV mountable subsea pump flushing and sampling system, according to some embodiments.

FIG. 2 is a diagram illustrating further detail of a pump module 120, SUTA 130, and ROV mountable subsea pump flushing and sampling system 140, according to some embodiments. After deployment and hook-up of a subsea pump module 120, the ROV 142 docks to the pump module 120, and connects the ROV subsea flushing and sampling skid 140 to the pump module 120 via jumper 240. Prior to opening the valve to the main umbilical feed line 230 from SUTA 130 to the pump barrier oil circuit, a flush is performed using flushing and sampling system 140 in order to flush out seawater ingress and particles. According to some embodiments, after the flushing process a sample is taken of the clean oil. According to some embodiments, the sample is checked at the ROV system 140 and according to other embodiments, the sample is checked at the surface after ROV 142 is retrieved. Upon acceptable sample analysis results, the barrier fluid supply from SUTA 130 is ready via feed line 230. According to some embodiments, flushing and sampling system 140 is an independent standardized ROV-mountable skid, which can be configured as part of a standard ROV tooling across different projects.

Figure 3:
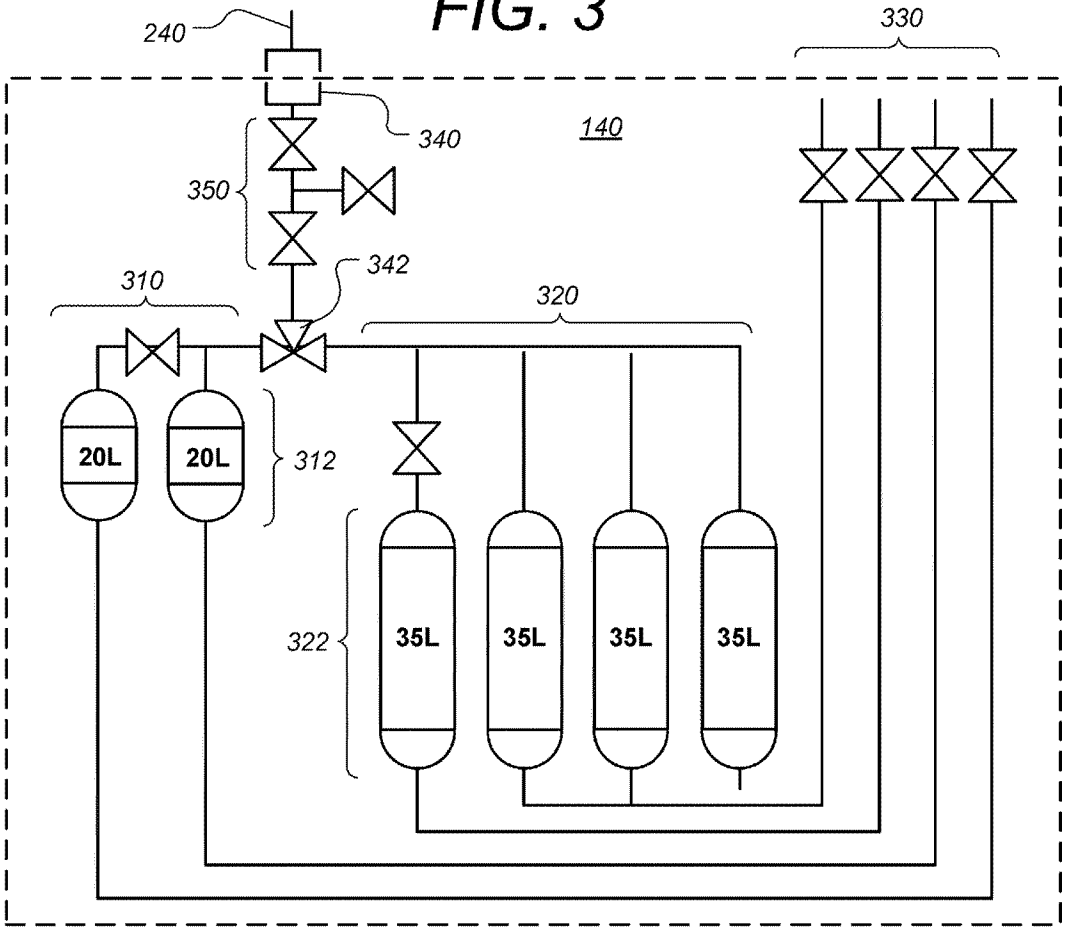
FIG. 3 is a hydraulic schematic illustrating aspects of an ROV mountable subsea pump flushing and sampling system, according to some embodiments.

FIG. 3 is a hydraulic schematic illustrating aspects of an ROV mountable subsea pump flushing and sampling system 140, according to some embodiments. Flushing and sampling system 140 includes a flushing system 320 that includes a plurality of flushing accumulators 322, and a sampling system 310 that includes one or more sampling accumulators 312. Note that although the accumulators 322 and 312 are shown in FIG. 3 with volumes of 35 liters and 20 liters, respectively, other quantities of accumulators and other volumes can be used depending on the application. This also applies to the other accumulators shown and described herein, including accumulators 412 and 422 in FIG. 4, and accumulators 512 and 514 in FIG. 5. In general, the set of flush accumulators 322 should have enough capacity to flush the installed jumpers clean. The sample accumulators 312 are used to sample the barrier oil subsea after flushing has been performed. The three-way valve 342 is used to select the flushing system 320 or the sampling system 310 for fluid connection to connector 340 that is attached to jumper 240 that leads to the pump module 120. On the surface, connector 340 is also used to access the fluid sample collected by the sampling system 310. The system 140 in FIG. 3 is a pressurized system. Connection ports 330 are used to both pressurize the accumulators 312 and 322. According to some embodiments, the skid 140 also includes function valves and double block and bleed valves 350 configured to perform cleaning, leakage test and sampling prior to or after subsea deployment. According to some embodiments, the sample accumulator circuit/system 140 also includes sensors (not shown) to do inline testing of the barrier oil for contaminants. The testing checks the water and particle content and transmits the results real time to ROV control room.

Figure 4:
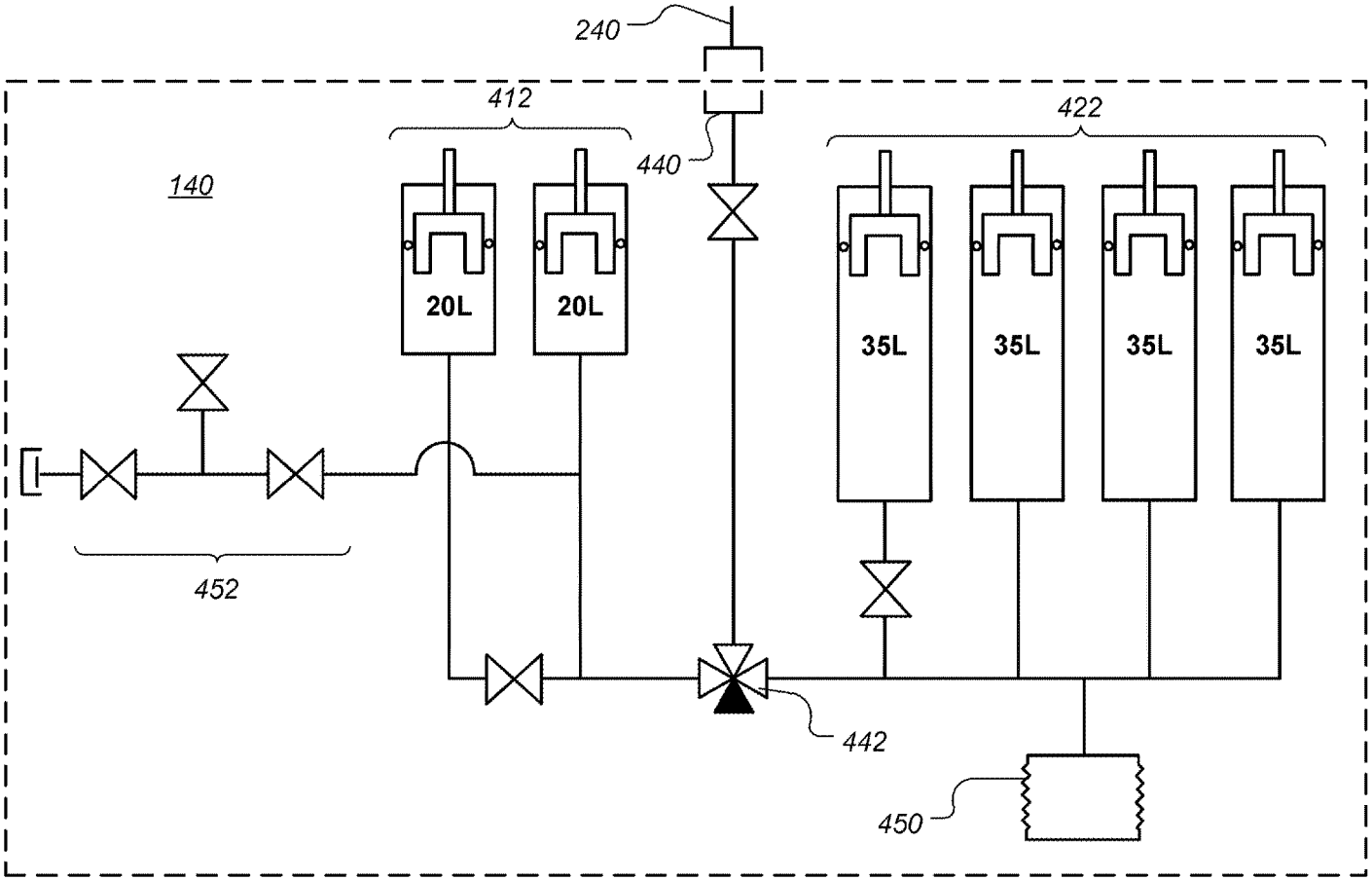
FIG. 4 is a hydraulic schematic illustrating aspects of a pressure compensated ROV mountable subsea pump flushing and sampling system, according to some embodiments.

FIG. 4 is a hydraulic schematic illustrating aspects of a pressure compensated ROV mountable subsea pump flushing and sampling system 140, according to some embodiments. The system shown in FIG. 4 is similar to that shown in FIG. 3 except that the flushing accumulators 422 and the sampling accumulators 412 are pressure compensated accumulators. As in the case of FIG. 3, three-way valve 442 is used to select the flushing accumulators 422 or the sampling accumulators 412 for fluid connection to connector 440 that is attached to jumper 240 that leads to the pump module 120. Compensator 450 is provided as shown in order to compensate the close volume to the environment (e.g., the sea water pressure). Double block and bleed valves 452 are for pressure release (static) of the sample accumulators 412 that may not have been pressure compensated during retrieval because three way valve 442 is closed against the compensator 450.

Figure 5:
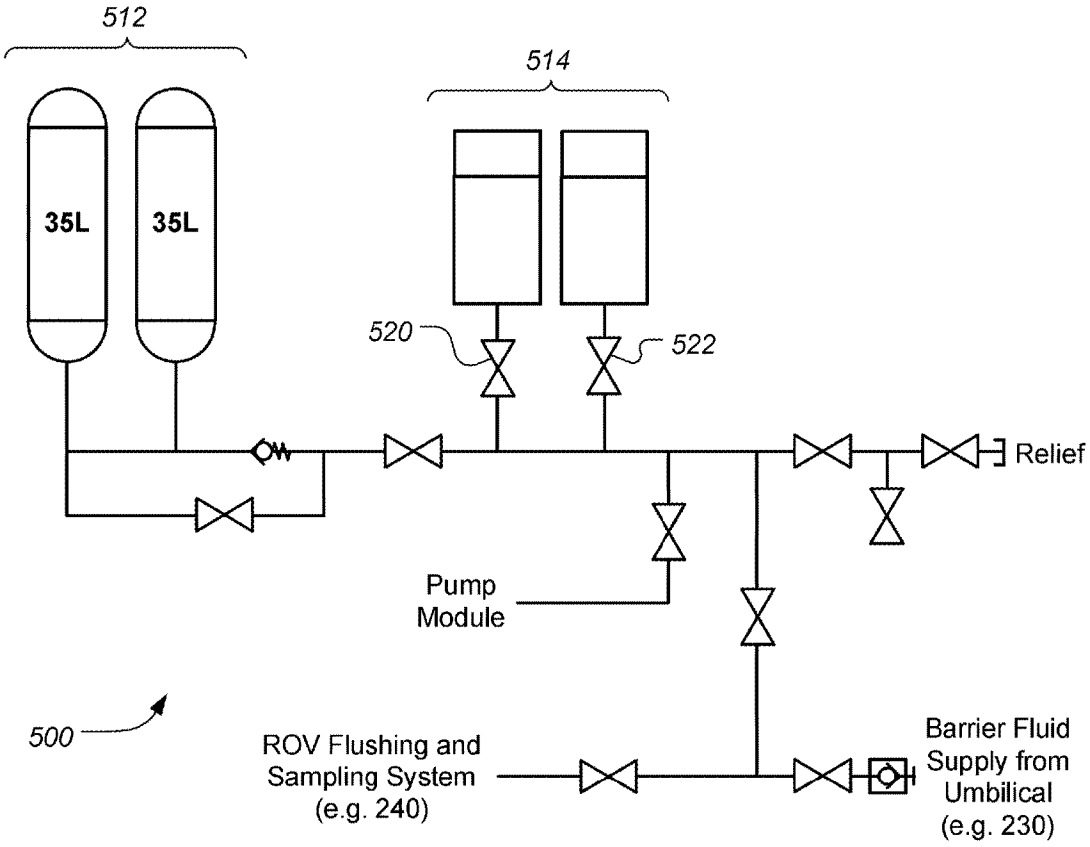
FIG. 5 is a hydraulic schematic illustrating aspect of a barrier fluid supply function for inclusion in a pump module, according to some embodiments.

FIG. 5 is a hydraulic schematic illustrating an aspect of a barrier fluid supply function for inclusion in a pump module, according to some embodiments. When using an ROV based pump flushing system, according to some embodiments, a barrier fluid supply system 500 is integrated into the pump module, such as pump module 120 shown in FIGS. 1 and 2. The system includes operational supply accumulators 512 and intermediate pump installation supply accumulators 514, which are isolatable using isolation valves 520 and 522. According to some embodiments, for deepwater installations typically 1500 m and below, a pressure compensation intensifier system is additionally built into the pump module 120. For further details regarding such pressure compensation, please refer to U.S. patent application Ser. No. 13/394,207, and Intl. Pat. Publ. No. WO 2011048213 A2, both of which are incorporated herein by reference.

Figure 6:
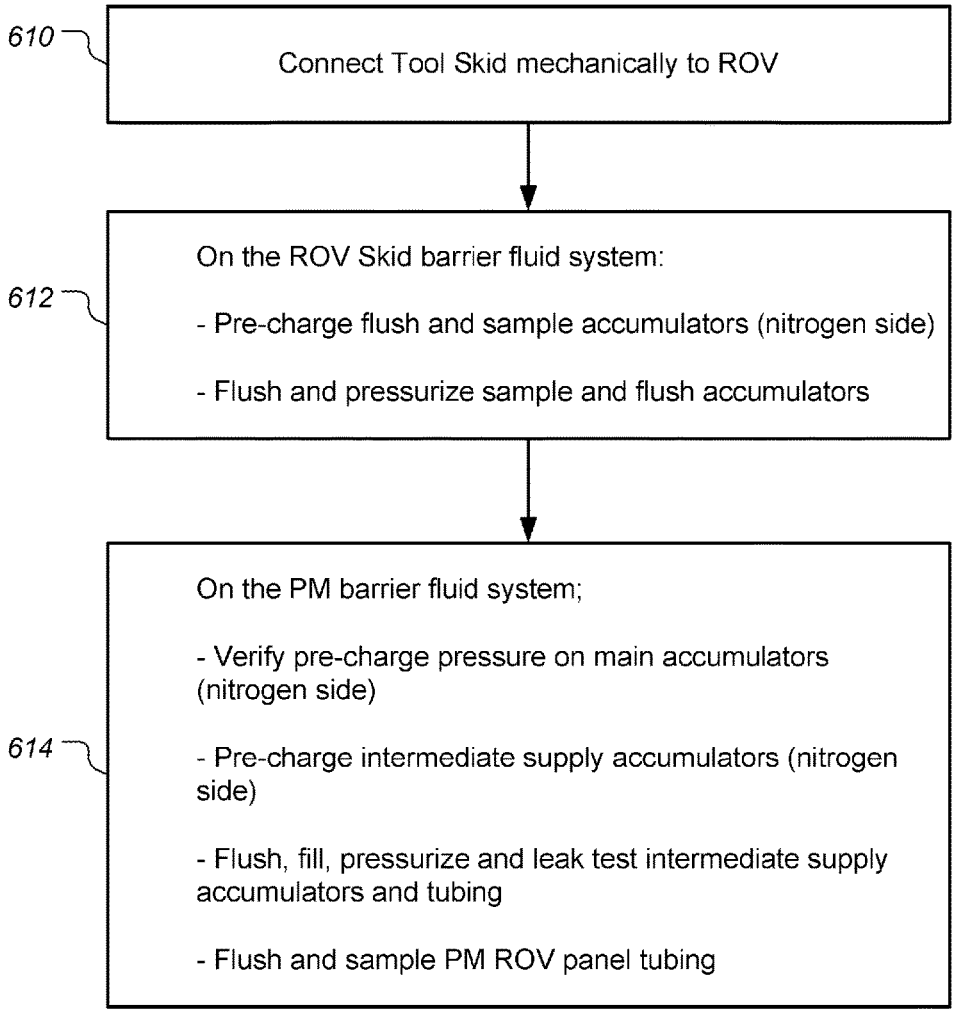
FIG. 6 is a flow chart illustrating aspects of preparation procedures for deploying a pump module and ROV mountable flushing and sampling system, according to some embodiments.

FIG. 6 is a flow chart illustrating aspects of preparation procedures for deploying a pump module and ROV mountable flushing and sampling system, according to some embodiments. In block 610, the ROV mountable flushing and sampling tool skid, such as skid 140, is mechanically mounted to the ROV, such as ROV 142 (shown in FIGS. 1 and 2). In block 612, on the flushing and sampling system (e.g., 140), the sample and flush accumulators (e.g., 312 and 322, respectively, in FIG. 3) are pre-charged on the gas side (e.g., nitrogen); and then flushed and pressurized. In block 614, on the pump module barrier fluid system (e.g., 500 in FIG. 5): a verification is made of the pre-charger pressure on the main accumulators (e.g., 512 in FIG. 5); the intermediate supply accumulators are pre-charged (e.g., 514 in FIG. 5); the intermediate supply accumulators and tubing are flushed, filled, pressurized and leak tested; and the pump module ROV panel tubing is flushed and sampled.

Figure 7:
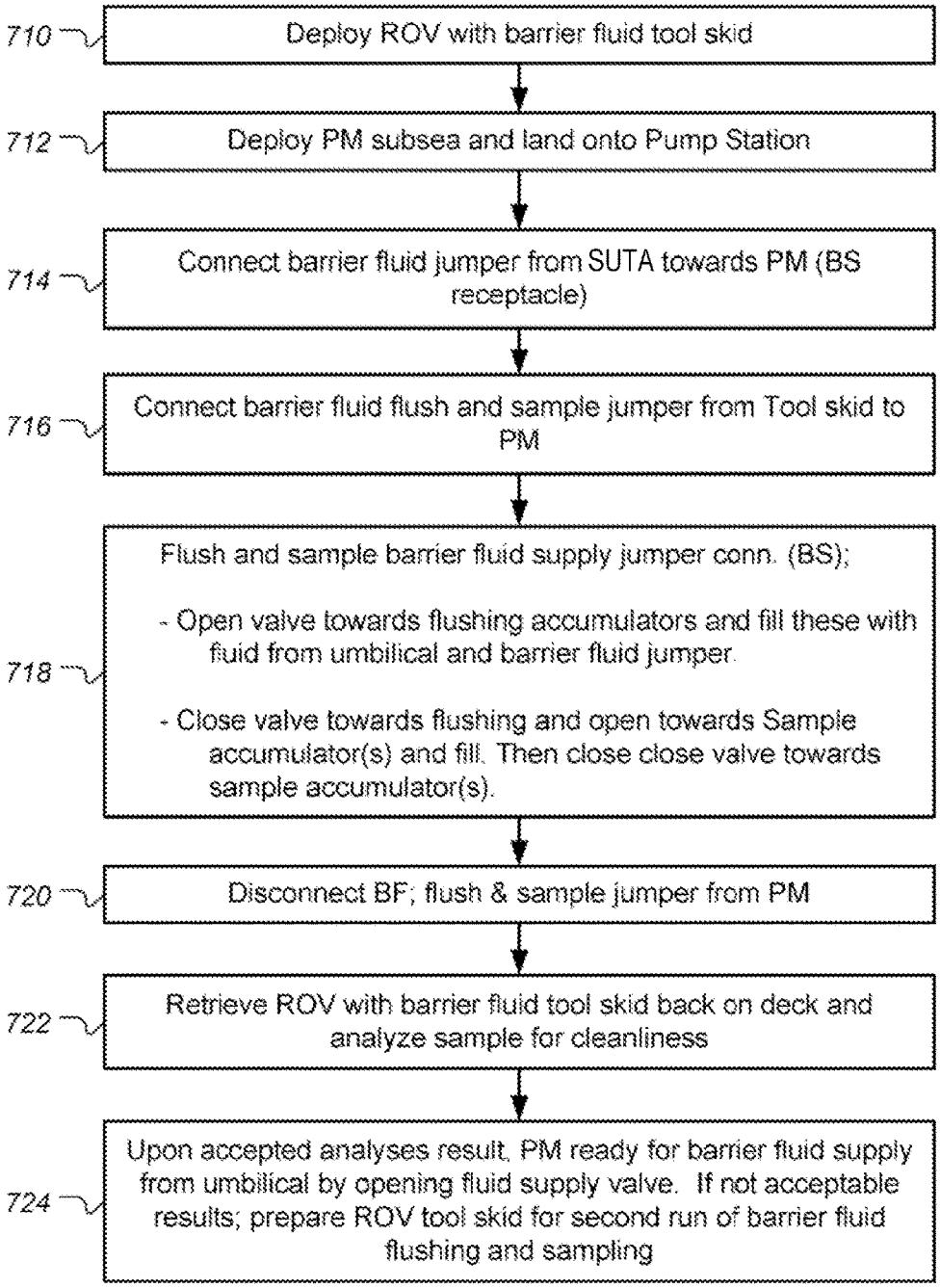
FIG. 7 is a flow chart illustrating aspects of deploying a pump module and ROV mountable flushing and sampling system, according to some embodiments.

FIG. 7 is a flow chart illustrating aspects of deploying a pump module and ROV mountable flushing and sampling system, according to some embodiments. In blocks 710 and 712, the ROV with the flushing skid (e.g., 142 and 140, respectively, FIGS. 1-2), and the pump module (e.g., 120 in FIGS. 1-2) are deployed to the subsea pump station (e.g., 114 in FIG. 1). In block 714, the barrier fluid jumper (e.g., 230 in FIG. 2) is connected from the SUTA (e.g., 130 in FIGS. 1-2) to the pump module (e.g., 120). In block 716, the flushing and sampling jumper (e.g., 240 in FIG. 2) is connected between the flushing and sampling skid (e.g., 140) and the pump module (e.g., 120). In block 718, the barrier fluid supply jumper connection is flushed and sampled. Referring to FIG. 3, the three-way valve 342 can first be opened towards flushing accumulators 322 so as to allow them to fill with fluid from the umbilical and barrier fluid jumper (e.g., 132 and 230, respectively, in FIG. 2). Then the three-way valve 342 is opened towards the sampling accumulators 312 to gather the fluid sample. Finally, the valve 342 is closed to isolate the sample.

In block 720, the flush and sample jumper (e.g., 240) is disconnected from the pump module (e.g., 120). In block 722, the ROV and flushing and sampling skid (e.g., 142 and 140, respectively) are retrieved to the vessel (e.g., 110 in FIG. 1), and the sample in the sample accumulators is analysed for cleanliness. In block 724, if the analysis yields acceptable results, the pump module is ready for barrier fluid supply from the umbilical. If the results are not acceptable, the ROV mounted flushing and sampling skid is prepared for a second run of barrier fluid flushing and sampling.

According to many of the embodiments described herein, several advantages can be realized by using an ROV flushing and sampling system such as described. The amount of working at height on deck during preparatory work tasks can be significantly reduced when compared to using a dedicated installation tool mounted on top of the subsea pump module. Furthermore, the ROV mountable implementation is a more weather robust system for subsea deployment and retrieval. A more intermediate barrier fluid supply is also available during installation and sampling operations. Pump module transferring functions in tooling can be avoided. The total pump module installation weight can be reduced, which is often an important consideration especially in deepwater applications. Finally, an industry standard can be provided with the ROV based tooling skid.

It is noted that the foregoing examples have been provided merely for the purpose of explanation and are in no way to be construed as limiting of the present disclosure. While the present disclosure has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present disclosure in its aspects. Although the present disclosure has been described herein with reference to particular means, materials and embodiments, the present disclosure is not intended to be limited to the particulars disclosed herein; rather, the present disclosure extends to all functionally equivalent structures, methods and uses, such as are within the scope of the appended claims.

The invention claimed is:

1. A subsea deployable production fluid processing system comprising:

a submersible electric motor configured to operate while filled with a barrier oil and to be deployed in a subsea location;

a supply receptacle configured to accept a supply conduit carrying the barrier oil and to supply the barrier oil to the submersible electric motor;

an ROV mountable flushing unit configured to be deployed to the subsea location while mounted to an ROV, said flushing unit including one or more flushing accumulators; and a valve system configured to allow entry of the barrier oil into said submersible electric motor from the supply conduit and to allow fluid communication with said ROV mountable flushing unit, said flushing accumulators configured to accept the barrier oil in said supply conduit so as to flush said supply conduit, wherein said ROV mountable flushing unit is disconnectable from said supply conduit to remove said flushed barrier oil.

2. A system according to claim 1 wherein the flushing unit includes at least one sampling accumulator configured to draw a fluid sample of barrier oil from said supply conduit after being flushed by the flushing accumulators.

3. A system according to claim 2 wherein said flushing unit is configured to produce a sample of barrier oil from said at least one sampling accumulator for analysis at a surface location after retrieval of said flushing unit by the ROV to the surface location.

4. A system according to claim 2 wherein the flushing unit includes a sample analyzer configured to analyze a collected sample of fluid from said supply conduit for contaminants in the barrier oil.

5. A system according to claim 1 further comprising a subsea umbilical interface unit in fluid connection with said supply conduit and an umbilical conduit from a surface facility, the umbilical interface unit configured to supply barrier oil from the umbilical conduit to said supply conduit.

6. A system according to claim 5 wherein the surface facility is of a type selected from a group consisting of: floating production storage and offloading unit; platform; and shore facility.

7. A system according to claim 5 wherein said umbilical interface unit is a subsea umbilical termination assembly.

8. A system according to claim 1 wherein said electric motor is configured to drive a type of equipment selected from a group consisting of: multiphase pump; single phase pump; hybrid pump; and compressor.

9. A system according to claim 1 wherein the fluid processing system includes one or more accumulators adapted to provide barrier oil supply pressure compensation.

10. An ROV mountable flushing unit comprising:

a frame configured for attachment to an ROV so as to allow deployment by the ROV of the flushing unit to a subsea location where a subsea processing system is located, said subsea processing system including a barrier oil filled electric motor and configured to fluidly connect to a barrier oil supply conduit to supply barrier oil to the electric motor; and one or more flushing accumulators mounted within said frame and configured to flush fluid from said barrier oil supply conduit following connection of the one or more flushing accumulators to said subsea processing system and remove said flushed fluid following disconnection of the one or more flushing accumulators from said subsea processing system.

11. A unit according to claim 10 further comprising at least one sampling accumulator configured to draw a fluid sample of barrier oil from said supply conduit after being flushed by the flushing accumulators.

12. A unit according to claim 11 wherein said flushing unit is configured to produce a sample of barrier oil from said at least one sampling accumulator for analysis at a surface location after retrieval of said unit by the ROV to the surface location.

13. A unit according to claim 11 further comprising a sample analyzer configured to analyze a collected sample of fluid from said supply conduit for contaminants in the barrier oil.

14. A unit according to claim 10 wherein said supply conduit is connected to a subsea umbilical interface unit configured to supply barrier oil from an umbilical conduit to said supply conduit.

15. A unit according to claim 10 wherein said one or more flushing accumulators are configured for pressurization prior to deployment.

16. A unit according to claim 10 wherein said one or more flushing accumulators are pressure compensated type accumulators.

17. A system according to claim 10 wherein said barrier oil filled electric motor is configured to drive a type of equipment selected from a group consisting of: multiphase pump; single phase pump; hybrid pump; and compressor.

18. A method for installing a fluid processing system in a subsea location, the method comprising:

positioning the fluid processing system in the subsea location, said fluid processing system including an electric motor configured for operation while filled with a barrier oil;

deploying a flushing unit mounted to an ROV to the subsea location, said flushing unit including one or more flushing accumulators;

connecting a supply conduit to said fluid processing system while at the subsea location, the supply conduit configured to supply barrier oil to said fluid processing system;

after said connecting, flushing fluid from said supply conduit into said one or more flushing accumulators of said flushing unit;

after said flushing, retrieving the flushing unit to a surface location using the ROV; and after said flushing, supplying barrier oil from said supply conduit to said electric motor.

19. A method according to claim 18 further comprising:

after said flushing and before said retrieving and said supplying, sampling a sample of fluid from said supply conduit by drawing said sample into a sampling accumulator on said flushing unit; and analyzing said sample for contaminants in the barrier oil, wherein said supplying is only performed in cases where the sample shows the barrier oil is suitably free from contaminants.

20. A method according to claim 19 wherein said analyzing takes place at the sea surface location after said retrieving of the flushing unit.

21. A method according to claim 19 wherein said analyzing takes place within the flushing unit while at said subsea location.

22. A method according to claim 18 wherein said supply conduit is connected to a subsea umbilical termination assembly configured to supply barrier oil from an umbilical conduit to said supply conduit.

23. A method according to claim 18 wherein said electric motor is configured to drive a type of equipment selected from a group consisting of: multiphase pump; single phase pump; hybrid pump; and compressor.

24. A method according to claim 18 further comprising, prior to deploying said flushing unit, pre-charging, flushing and pressuring each of said one or more flushing accumulators.

25. A method according to claim 18 further comprising, prior to positioning the fluid processing system, flushing, filling, and leak testing at least one accumulator on said fluid processing system.

* * * * *